US009567143B2

(12) United States Patent
Carvajal et al.

(10) Patent No.: US 9,567,143 B2
(45) Date of Patent: Feb. 14, 2017

(54) TAMPER EVIDENT CLOSURE FOR CONTAINERS

(71) Applicant: West Pharmaceutical Services, Inc., Exton, PA (US)

(72) Inventors: Michael A. Carvajal, Chicago, IL (US); Sean J. Corrigan, Chicago, IL (US); Keith Grider, Chicago, IL (US); Phil Humphrey, Ruskin, FL (US); Markus Vor Dem Esche, Roetgen (DE); John R. Wolfe, Selinsgrove, PA (US); Xia Zhao, Malvern, PA (US)

(73) Assignee: West Pharmaceutical Services, Inc., Exton, PA (US)

( * ) Notice: Subject to any disclaimer, the term of this patent is extended or adjusted under 35 U.S.C. 154(b) by 0 days.

(21) Appl. No.: 14/913,567

(22) PCT Filed: Dec. 19, 2013

(86) PCT No.: PCT/US2013/076595

§ 371 (c)(1),
(2) Date: Feb. 22, 2016

(87) PCT Pub. No.: WO2015/094292

PCT Pub. Date: Jun. 25, 2015

(65) Prior Publication Data

US 2016/0280431 A1 Sep. 29, 2016

(51) Int. Cl.

| | |
|---|---|
| ***B65D 41/32*** | (2006.01) |
| ***B65D 55/02*** | (2006.01) |
| ***B65D 51/24*** | (2006.01) |

(52) U.S. Cl.

CPC ..... *B65D 55/024* (2013.01); *B65D 51/245* (2013.01)

(58) Field of Classification Search

CPC ..... B65D 2101/0023; B65D 17/501; B65D 2101/00; B65D 2101/003; B65D 51/002; B65D 51/245; G09F 3/0292

(Continued)

(56) References Cited

U.S. PATENT DOCUMENTS 4,687,113 A * 8/1987 Reeve ..... B65D 55/066 215/230
5,377,853 A * 1/1995 Papciak ..... A61J 1/03 206/459.5

(Continued)

FOREIGN PATENT DOCUMENTS

WO 2007096674 A1 8/2007

OTHER PUBLICATIONS

Steri-Temp Product Use Instruction Sheet (admitted prior art).

(Continued)

*Primary Examiner* — Shawn M Braden
(74) *Attorney, Agent, or Firm* — Panitch Schwarze Belisario & Nadel LLP

(57) ABSTRACT

A tamper-evident closure (110) for containers includes a closure shell (112) having a top surface (118) and a depending skirt (120). The top surface defines a first aperture (124) therethrough and a frangible portion (122). The skirt defines an open lower end (20*a*) for engaging a container. A tamper-evident tearable member (114) overlies the top surface of the closure shell and defines a second aperture (126) overlying the first aperture. A removable closure cap (116) overlies the top surface of the closure shell and the tearable member. The closure cap has an annular ring (132) projecting downwardly from an under-side of the closure cap and extending through the first and second apertures. The annular ring attaches to an underside of the frangible portion. At least partial removal of the closure cap from the top surface (Continued)

of the closure shell peels the frangible portion away from the top surface of the closure shell along the scoring, and tears the tamper-evident member.

13 Claims, 5 Drawing Sheets

(58) Field of Classification Search
USPC ..... 220/266, 257.1; 215/249, 250, 253
See application file for complete search history.

(56) References Cited

U.S. PATENT DOCUMENTS 5,678,718 A * 10/1997 Morris ..... B65D 45/322 215/213
6,578,723 B1 6/2003 Tyner
7,394,383 B2 7/2008 Hager et al.
8,113,367 B2 * 2/2012 Pawlick ..... B65D 47/0838 215/14
8,523,837 B2 * 9/2013 Wiggins ..... B65D 51/225 206/221
2003/0168456 A1 9/2003 Tomasella
2006/0234014 A1 * 10/2006 Liu ..... B65D 33/34 428/195.1
2006/0234040 A1 * 10/2006 Liu ..... B44F 1/00 428/343
2008/0047976 A1 * 2/2008 Scheer ..... B65D 47/0809 222/153.06
2014/0346172 A1 * 11/2014 Banerjee ..... B65D 43/22 220/257.1
2016/0184182 A1 6/2016 Gross et al.

OTHER PUBLICATIONS

Int'l Search Report and Written Opinion issued Sep. 15, 2014 in Int'l Application No. PCT/US2013/076595.
Int'l Preliminary Report on Patentability issued Jun. 30, 2016 in Int'l Application No. PCT/US2013/076595.

* cited by examiner

TAMPER EVIDENT CLOSURE FOR CONTAINERS

CROSS-REFERENCE TO RELATED APPLICATION

This application is a section 371 of International Application No. PCT/US2013/076595, filed Dec. 19, 2013, which was published in the English language on Jun. 25, 2015 under International Publication No. WO 2015/094292, the disclosure of which is incorporated herein by reference.

BACKGROUND OF THE INVENTION

The present invention relates to a closure for containers, such as, for example, pharmaceutical vials, and more particularly to a closure for containers that indicates whether the closure has been tampered with or previously opened or accessed.

Containers, such as, for example, pharmaceutical vials, often contain contents that may be compromised once exposed to the environment, or even if merely unsealed. Such contents, for example, may be intended for single use consumption only. In such applications, it is important for a user, such as, for example, a health care worker, to be able to determine whether the contents within a container have been previously exposed and are therefore no longer suitable for use, or dispensing, or whether the contents have not been previously accessed or exposed and are suitable for use.

Alternatively, in many applications, whether medical or non-medical a manufacturer may wish to instruct consumer and/or end users to not purchase or use product within a container that has been tampered with or opened prior to purchase. Similarly, it is often preferred by an end-user and/or consumer to be able to determine whether a particular container of product to be purchased has been previously opened or tampered with. Likewise, it is often equally important for a place of business to be able to determine whether a container of product has been opened or tampered within, such as, for example, after purchase because certain products sold in containers are no longer returnable once opened.

Therefore, it would be advantageous to have a closure for containers that can indicate whether or not the closure has been opened or accessed. Such a closure, usable with different existing container designs in the market, would minimize the costs associated with designing and manufacturing new containers that indicate whether or not the container has been previously opened, accessed or tampered with.

The invention provides tamper evident closures for containers, particularly, tamper evident closures for containers having an open end for assembling with a closure.

BRIEF SUMMARY OF THE INVENTION

Briefly stated, one aspect of the present invention is directed to a tamper evident closure for containers. The closure includes a closure shell having a top surface and a depending skirt. The top surface defines a first aperture extending therethrough and a frangible portion surrounding the first aperture. The depending skirt defines an open lower end for engagement with an open end of a container. A tamper evident tearable member overlies at least a portion of the top surface of the closure shell and defines a second aperture overlying the first aperture. A removable closure cap overlies the top surface of the closure shell and the tamper evident tearable member. The closure cap has an annular ring projecting downwardly from an underside of the closure cap and extending through the first and second apertures. The depending annular ring attaches to an underside of the frangible portion. At least partial removal of the closure cap from the top surface of the closure shell peels at least a portion of the frangible portion away from the top surface of the closure shell along the scoring, and at least partially tears the tamper evident tearable member.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
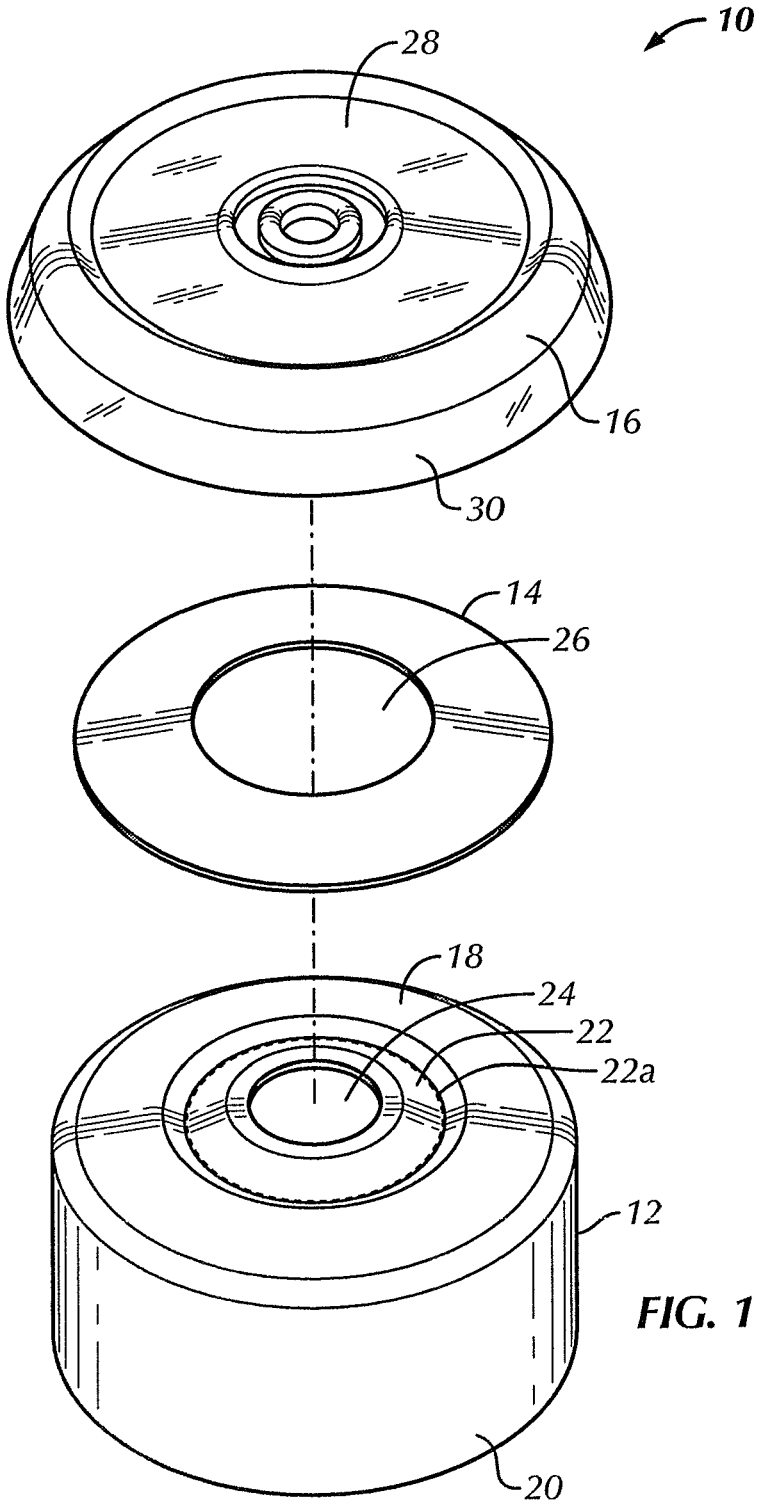
FIG. 1 is an exploded perspective top view of a tamper evident closure according to a first embodiment of the present invention.

Certain terminology is used in the following description for convenience only and is not limiting. The words "bottom" and "top" designate directions in the drawings to which reference is made. Hereinafter, the terms "proximal" and "rear" are synonyms, as are the terms "distal" and "front." The word "inwardly" and "outwardly" refer to directions toward and away from, respectively, the geometric center of the closure, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

Figure 2A:
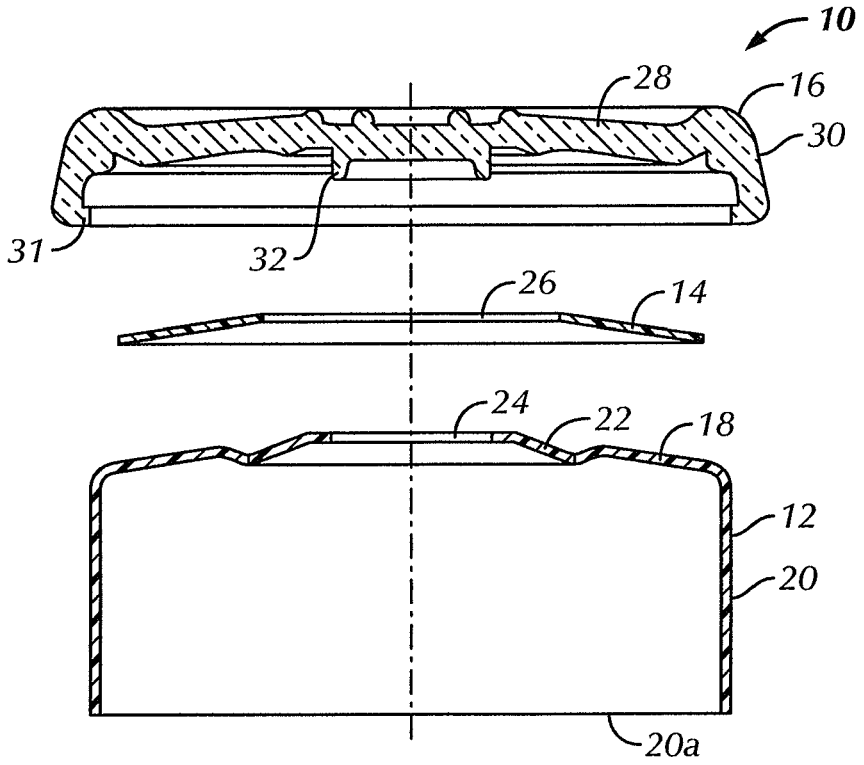
FIG. 2A is an exploded cross-sectional elevational view of the tamper evident closure of FIG. 1.
Figure 2B:
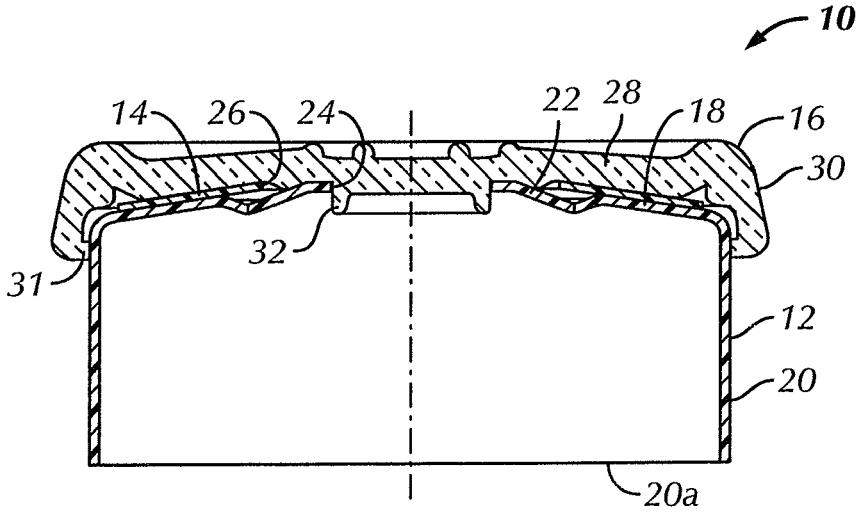
FIG. 2B is a cross-sectional elevational view of an assembled tamper evident closure of FIG. 1.

Referring to the drawings in detail, wherein the same reference numerals indicate the same components throughout the figures, there is shown in FIGS. 1-2B a first embodiment of a tamper evident closure, generally designated 10, for engagement with a container (not shown). As shown best in FIGS. 1 and 2A, the tamper evident closure 10 includes a closure shell 12, a single layer tamper evident tearable member 14 overlying the closure shell 12 and a removable closure cap 16 covering the closure shell 12 and the tamper evident tearable member 14.

The closure shell 12 includes a generally planar top surface 18 and a skirt wall 20 depending from the top surface 18. In the illustrated embodiment, the top surface 18 is generally circular in shape, and the depending skirt wall 20 is correspondingly generally cylindrical. However, as should be understood by those of ordinary skill in the art, the top surface 18 and the skirt wall 20 may define any of numerous different complementary shapes. For example, without limitation, the top surface 18 could be rectangular and the skirt wall 20 cubical. The closure shell 12 may be constructed of a metallic material, e.g., aluminum, a polymeric material or any other material known in that art, suitable for the functions of the closure shell 12 as described herein.

As shown in FIGS. 2A and 2B, the skirt wall 20 defines an open lower (base) end 20*a* of the closure shell 12 for engagement with an open end of a container (not shown). As should be understood by those of ordinary skill in the art, the open lower end 20*a* of the closure shell 12 may be engaged with an open end of a container in any of numerous methods known in the art, such as, for example, but not limited to, via crimping the skirt wall 20 around a flange delimiting the open end of the container, via a compression fit between the skirt wall 20 and the open end of the container, or via a threaded fit between the skirt wall 20 and the open end of the container. In certain applications, such as, for example, but not limited to, pharmaceutical applications, wherein the contents within the container are sterile (and require remaining sterile) and/or must be sealed from the atmosphere, the closure shell 12 may be sealingly engaged with the open end of a container via any of the conventional methods known in the art.

The top surface 18 of the closure shell 12 includes a generally circularly shaped frangible portion 22. The boundary, e.g., perimeter or circumference, of the frangible portion 22 is scored, such that the frangible portion 22 is removable from the top surface 18 of the closure shell 12 by tearing along the score line 22*a* (as described further below). However, as should be understood by those of ordinary skill in the art, the frangible portion 22 may be connected to the remainder of the closure shell 12 via frangible connections other than the score line 22*a*. For example, without limitation, the frangible portion 22 may be connected to the remainder of the closure shell 12 via a plurality of discrete frangible "bridge" connectors. The frangible portion 22 includes a first aperture 24. In the illustrated embodiment, the frangible portion 22 is approximately centrally disposed on the top surface 18, and the first aperture 24 is approximately centrally disposed on the frangible portion 24 and the top surface 18. However, as also should be understood by those of ordinary skill in the art the frangible portion 22 and/or the first aperture 24 may alternatively be off-centered or may have a non-circular shape.

As shown best in FIG. 2B, the tamper evident tearable member 14 in the present embodiment is generally circular shaped and overlies at least a portion of the top surface 18 of the closure shell 12. The tearable member 14 thus defines a surface area of equal, or less, area than the surface area of the top surface 18 of the closure shell 12. In the illustrated embodiment, the tearable member 14 overlies substantially the entirety of the surface area of the top surface 18. The tearable member 14 is securely attached or adhered to the top surface 18 of the closure shell 12 via any conventional attachment methods or means known in the art, such as, for example, via adhesive. The tamper evident tearable member 14 includes a second aperture 26 positioned to overly, i.e., be aligned and in registry with, the first aperture 24 of the closure shell 12. Thus, in the illustrated embodiment, the second aperture 26 is approximately centrally disposed on the tamper evident member 14. However, similarly to the first aperture 24, the second aperture 26 may be off-centered to overly an off-centered first aperture 24. The second aperture 26 is at least slightly smaller than the pre-scored frangible portion 22 of the closure shell 12, for reasons described further below. The tamper evident tearable member 14 may be constructed of a single tearable foil or paper layer that will tear or rip when removing, or partially removing, the closure cap 16 from the closure shell 12 (as described further below), or any other material known in that art, suitable for the functions of the tearable member 14 as described herein.

As shown best in FIGS. 1 and 2A, the closure cap 16 defines a top surface 28 and a skirt wall 30 depending from the top surface 28. In the illustrated embodiment, and correspondingly to the closure shell 12, the top surface 28 is generally circular in shape, and the depending skirt wall 30 is generally cylindrical. The closure cap 16 is dimensioned to fittingly engage the closure shell 12 when mounted on the closure shell 12. As shown in FIGS. 2A and 2B, the skirt wall 30 depends from the top surface 28 of the closure cap 16 at a slightly obtuse angle and is configured to releasably engage at least a portion of the skirt wall 20 of the closure shell 12. However, as should be understood, the skirt wall 30 of the closure cap 16 may alternatively depend from the top surface 28 of closure cap 16 at a right angle or at a slightly acute angle, for example, to create an interference fit between the skirt wall 30 of the closure cap 16 and the skirt wall 20 of the closure shell 12. As shown in FIG. 2A, the skirt wall 30 of the closure cap 16 includes a laterally inwardly extending annular lip 31 at the lower end of the skirt wall 30, which engages the outer surface of the skirt wall 20 of the closure shell 12. In the illustrated embodiment, the annular lip 31 frictionally engages the outer surface of the skirt wall 20 of the closure shell 12. However, as should be understood, the annular lip 31 may engage the outer surface of the skirt wall 20 via any conventional engagement methods or means known in the art, such as, for example, via a snap fit engagement.

As also shown in FIG. 2A, the closure cap 16 also includes an annular ring 32 projecting downwardly and outwardly from an underside of the top surface 28. The annular ring 32 is positioned and dimensioned to extend through the first and second apertures 24, 26 of the closure shell 12 and the tearable member 14, respectively, when the removable closure cap 16 is assembled to the closure shell 12. After assembly of the closure cap 16 to the closure shell 12, with the tearable member 14 interposed therebetween, as shown in FIG. 2B, the outward projection of the ring 32 prevents the separation of the ring 32 from the frangible portion 22 of the closure shell 12, as described further below. Additionally, or alternatively, the free, bottom end of annular ring 32 may be heat staked or fused to the underside of the frangible portion 22 to prevent separation of the ring 32 from the frangible portion 22. The closure cap 16 may be constructed of a flexible polymeric material, e.g., polypropylene, or any other material known in that art, suitable for the functions of the closure cap 16 as described herein. In some embodiments, the closure cap 16 is also transparent or translucent, such that the underlying tamper evident tearable member 14 is visible through the closure cap 16.

To assemble the closure 10, a tamper evident tearable member 16 is securely attached or adhered to the top surface 18 of a closure shell 12 via conventional attachment methods or means known in the art. A closure cap 16 is thereafter mounted atop the tamper evident tearable member 16 into engagement with the closure shell 12, such that the ring 32 of the closure shell 12 extends through the second aperture 26 of the tearable member 14 and through the first aperture 24 of the closure shell 12. The free, bottom end of the ring 32 is then securely attached, such as, for example, via heat staking or fusing, to the underside of the frangible portion 22, thereby preventing separation of the ring from the frangible portion 22 afterwards. The open lower end 20*a* of the closure shell 12 may thereafter be engaged with an open end of a container via conventional attachment methods or means known in the art.

In use, the assembled closure 10 is mounted on an open end of a container. In some applications, a stopper, e.g., an elastomeric stopper, is also plugged into the open end of the container, prior to mounting of the closure 10 onto the container. Prior to assembly of the closure 10 to the container, the container may be filled with a substance through the open end of the container, or in applications where an elastomeric stopper is inserted into the open end of the container, through the stopper. Alternatively, the container may be filled through any other end, port or valve. The container may be filled via any of the conventional methods known in the art.

After assembly of the closure 10 to a container, and prior to removal of the closure cap 16, the transparent or translucent closure cap 16 allows a user, e.g., a health care worker, to see (through the cap 16) that the tamper evident tearable member 14 is intact and not torn. Therefore, a user will know that the container has not been tampered with, i.e., the closure cap 16 has not been previously removed, or partially removed, whether advertently or inadvertently, and the contents within the container have not been compromised.

When the closure cap 16 is desired to be removed, a user merely presses upwardly against the closure cap 16, lifting the cap 16 away from the closure shell 12. As indicated above, the annular ring 32 does not separate from the frangible portion 22 of the top surface 18 of the closure shell 12. Rather, the frangible portion 22 remains engaged with the ring 32, and as the closure cap 16 is moved away from the top surface 18 of the closure shell 12, the frangible portion 22 separates from the remainder of the top surface 18 along the score line 22*a*, and peels away from the top surface 18. As the frangible portion 22 is larger than the overlying second aperture 26 of the tearable member 14 (and therefore cannot merely pass through the second aperture 26), and as the tearable member 14 is adhered to the top surface 18 of the closure shell 12, the frangible portion 22 tears the portion of the tearable member 14 adhered to the frangible portion 22 away from the remainder of the tearable member 14 adhered to the remainder of the top surface 18 of the closure shell 12. Thereafter, the torn tearable member 14 indicates that the closure cap 16 has been previously removed, partially removed. Thus, even if the closure cap 16 is reinserted back onto the closure shell 12, a user can easily notice through the transparent or translucent cap 16 that the underlying tearable member 14 is torn, and therefore immediately know that the cap 16 has been previously removed, or partially removed.

Figure 3:
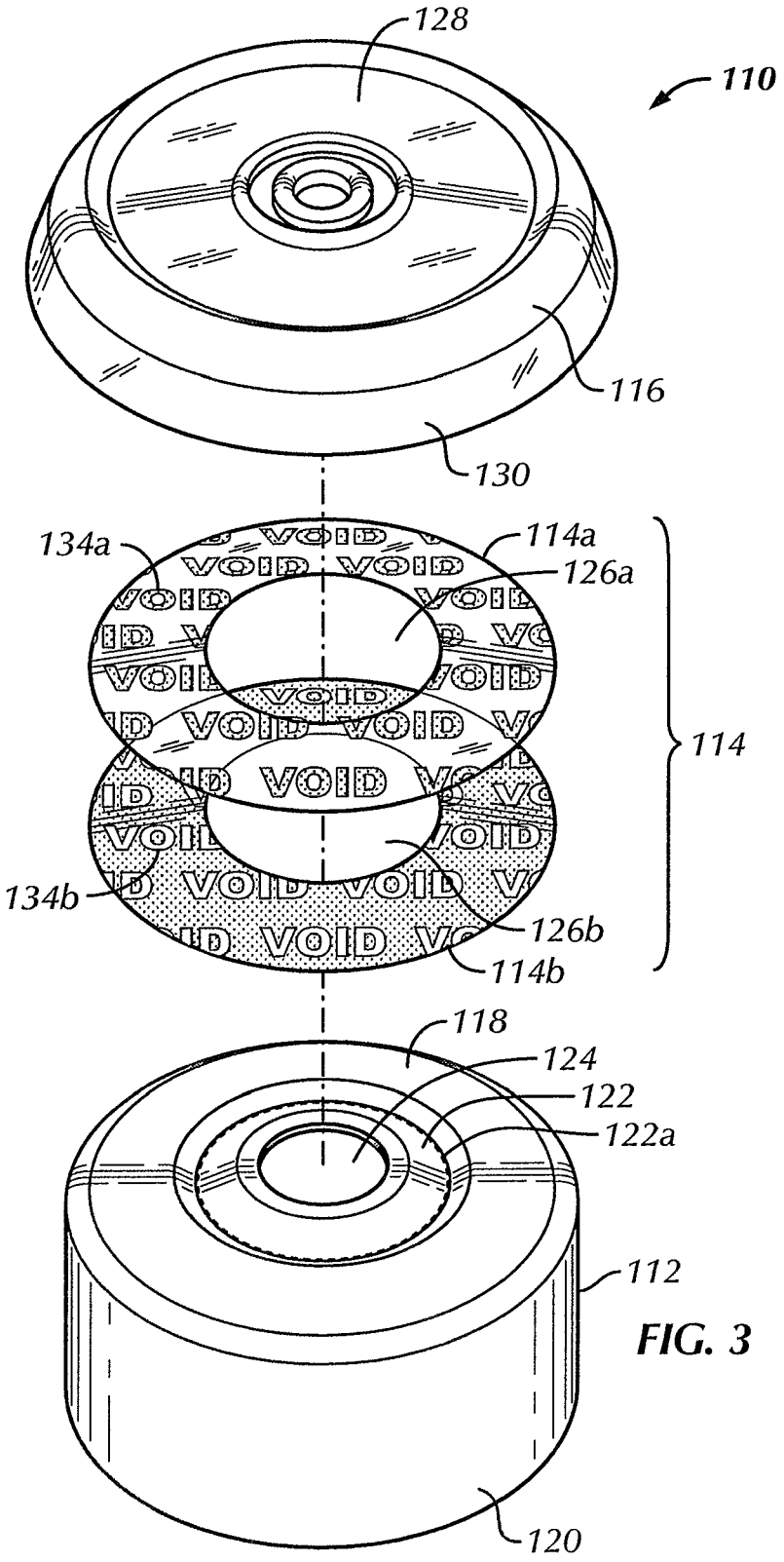
FIG. 3 is an exploded top perspective view of a tamper evident closure according to a second embodiment of the present invention.
Figure 4A:
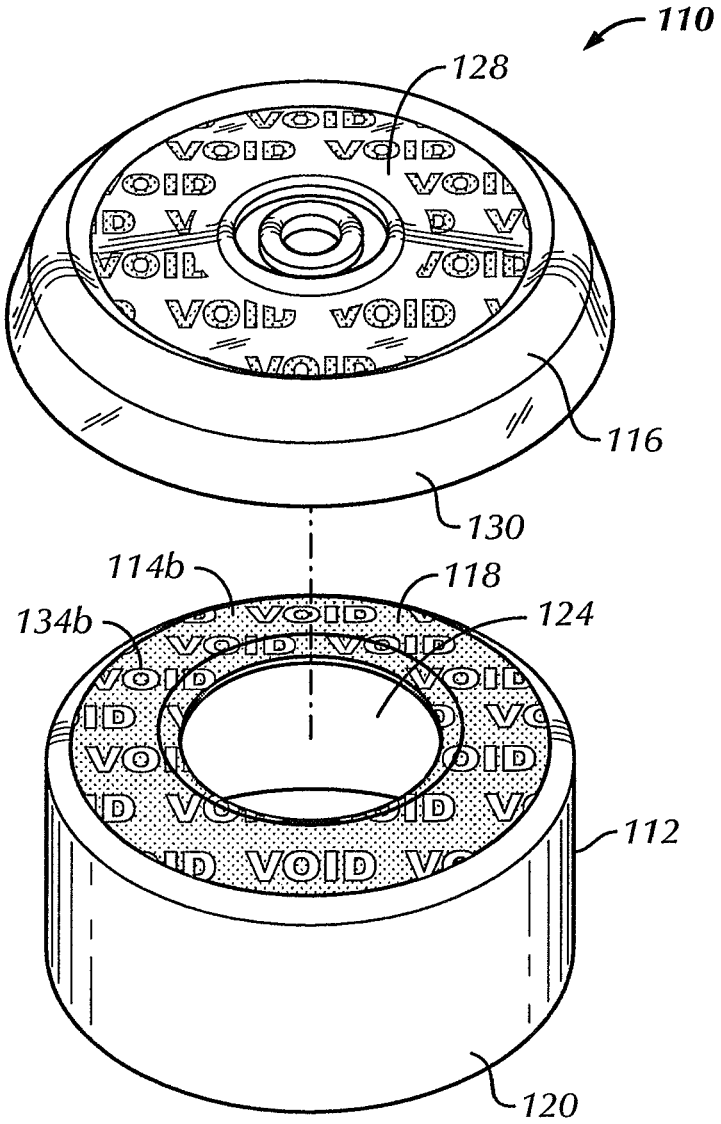
FIG. 4A is a top perspective view of the tamper evident closure of FIG. 3 with a transparent closure cap, an upper layer of a tamper evident tearable member and a frangible portion of a closure shell removed from the closure shell.
Figure 4B:
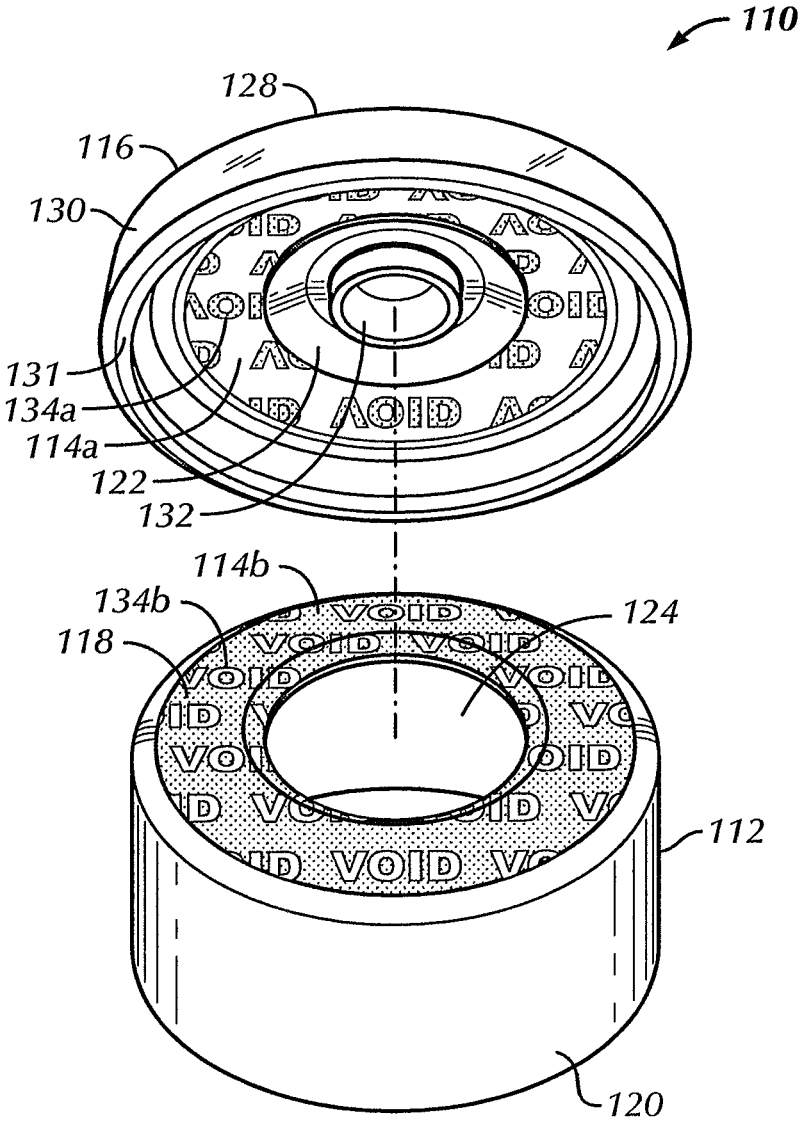
FIG. 4B is a top perspective view of the tamper evident closure of FIG. 3, showing the underside of a removed and angled transparent closure cap including the upper layer of the tamper evident tearable member and the frangible portion of the closure shell.

FIGS. 3-4B show a second embodiment of the closure 110. The reference numerals of the second preferred embodiment are distinguishable from those of the first embodiment by a factor of one-hundred (100), but otherwise indicate the same elements as indicated in the first preferred embodiment, except as otherwise specified. The closure 110 of the second embodiment is substantially similar to that of the first embodiment. The description of certain similarities between the embodiments may be omitted herein for the sake of brevity and convenience, and, therefore, is not limiting.

A distinguishing feature of the second preferred embodiment is that the tearable member 114 includes two equally dimensioned layers; an upper layer 114*a* and a bottom layer 114*b*. As shown best in FIG. 3, the bottom layer 114*b* is generally of a first color and has indicia 134*b* of a contrasting color placed or printed onto the bottom layer 114*b*. The upper layer 114*a*, overlying the bottom layer 114*b* is transparent and has the same indicia 134*a* placed or printed onto the upper layer 114*a* in the first color in the same respective location as the indicia on the bottom layer 114*b*. Accordingly, when the upper layer 114*a* overlies the bottom layer 114*b*, the indicia 134*a* of the first color on the upper layer 114*a* overly the indicia 134*b* on the bottom layer 114*b*, and thus the tearable member 114 appears as a single layer of the solid first color, having no indicia. The upper and bottom layers 114*a*, 114*b*, include mirrored overlying second apertures 126*a*, 126*b*, respectively. The upper and bottom layers 114*a*, 114*b* of the tamper evident tearable member 114 may, in some embodiments, be constructed of a polymeric material capable of tearing or ripping when removing the closure cap 116 from the closure shell 112, substantially without forming particulates that may otherwise fall into and contaminate the contends within a container. However, as should be understood by those of ordinary skill in the art, the upper and/or bottom layers 114*a*, 114*b* may alternatively be constructed of any other material known in that art, suitable for the functions of the tearable member 114 as described herein.

When the closure 110 is assembled, the upper layer 114*a* removably overlies the bottom layer 114*b*, such that the upper layer 114*a* can be peeled away from the bottom layer 114*b*. The underside of the bottom layer 114*b* is securely attached or adhered to the upper surface 118 of the closure shell 112, and upper surface of the upper layer 114*a* is securely attached or adhered to the underside of the closure cap 116. The respective surfaces of the upper and bottom layers 114*a*, 114*b* are securely attached or adhered to the respective surfaces of the closure cap 116 and the closure shell 122 via any of the conventional attachment means known in the art, such as, for example, via adhesive.

The annular ring 132 of the closure cap 116 is positioned and dimensioned to extend through the second apertures 126*a*, 126*b* of the tearable member 114 and the first aperture 124 of the closure shell 112, when the removable closure cap 116 is assembled to the closure shell 112. Similarly to the first embodiment, after assembly of the closure cap 116 to the closure shell 112, with the tearable member 114 interposed therebetween, the outward projection of the ring 132 prevents the separation of the ring 132 from the frangible portion 122 of the closure shell 112. Additionally, or alternatively, the free, bottom end of annular ring 132 may be heat staked or fused to the underside of the frangible portion 122.

After assembly of the closure 110 to a container, and prior to removal of the closure cap 116, the transparent or translucent closure cap 116 allows a user to see (through the cap 116) an intact tearable member 114 that appears as a single solid colored layer having no indicia thereon. It will therefore be apparent to the user that the tearable member 114 has not been tampered with, i.e., the closure cap 116 has not been previously removed or partially removed, whether advertently or inadvertently, and the contents within the container have not been compromised.

When the closure cap 116 is desired to be removed, a user presses upward against the closure cap 116, lifting the cap 116 away from the closure shell 112. As the closure cap 116 is removed from the closure shell 112, the upper layer 114*a* of the tearable member 114 (adhered to the closure cap 116) progressively peels away from the bottom layer 114*b* (shown fully peeled away in FIG. 4B), and reveals the indicia on the bottom layer 114*b* (FIG. 4A). Additionally, as the closure cap 116 is lifted away from the top surface 118 of the closure shell 112, the frangible portion 122 breaks away from the top surface 118 along the scoring of the frangible portion 122. As the frangible portion 122 is larger than the overlying second apertures 126*a*, 126*b* of the tearable member 114, and as the bottom layer 114*b* of the tearable member 114 is adhered to the top surface 118 of the closure shell 112, the frangible portion 122 tears the portion of the bottom layer 114*b* adhered to the frangible portion 122 away from the remainder of the bottom layer 114*b* adhered to the remainder of the top surface 118 of the closure shell 112. Thus, when the closure cap 116 is removed (FIG. 4A) a first time, the visible indicia on the bottom layer 114*b* of the tearable member 114, as well as the tearing in the bottom layer 114*b* of tearable member 114, indicate that the closure cap 116 has been previously removed. Thus, even if the closure cap 116 is remounted back onto the closure shell 112, a user can notice through the transparent or translucent cap 116 that the underlying bottom tearable member layer 114*b* is torn. Also, remounting of the closure cap 116 onto the closure shell 112 does not reattach the upper layer 114*a* with the bottom layer 114*b* and therefore the indicia on the bottom layer 114*b* remain visible. The tearing and the indicia indicates to a user that the cap 116 has been previously removed.

As should be understood by those of ordinary skill in the art, however, the indicia on the bottom layer 114*b* and the top layer 114*a*, utilized to indicate tampering (as described above), need not cover the entire top and bottom layers 114*a*, 114*b*. Alternatively, for example, the indicia utilized for indication of tampering may cover a portion of the respective top and bottom layers 114*a*, 114*b*, such as, for example, one half of the respective top and bottom layers 114*a*, 114*b*. The other respective portion of the top and bottom layers 114*a*, 114*b* may have indicia thereon utilized for other purposes, such as, for example, without limitation, product warnings. For example, the warning "paralyzing agent" may be printed on a portion of the bottom layer 114*a*, and visible through an indicia-free overlying portion of the transparent top layer 114*a*. The remaining portion of the respective top and bottom layers 114*a*, 114*b* can include indicia utilized for indicating tampering, as discussed above.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

We claim:

1. A tamper evident closure for a container comprising:

a closure shell having a top surface and a depending skirt, the top surface defining a first aperture extending therethrough and a scored frangible portion surrounding the first aperture, the depending skirt defining an open lower end for engagement with an open end of a container;

a tamper evident tearable member overlying at least a portion of the top surface of the closure shell and defining a second aperture overlying the first aperture; and a removable closure cap overlying the top surface of the closure shell and the tamper evident tearable member, the closure cap having an annular ring projecting downwardly from an underside thereof, extending through the first and second apertures and attached to an underside of the frangible portion, wherein at least partial removal of the closure cap from the top surface of the closure shell peels at least a portion of the frangible portion away from the top surface of the closure shell along said scoring, thereby at least partially tearing the tamper evident tearable member.

2. A tamper evident closure as defined in claim 1, wherein the tearable member comprises a single foil or paper layer.

3. A tamper evident closure as defined in claim 1, wherein the tearable member comprises a bottom layer of a first color having indicia of a contrasting color thereon, and a transparent overlying upper layer having the same indicia thereon in the same respective location and in the first color, the upper and bottom layers define mirrored overlying second apertures.

4. A tamper evident closure as defined in claim 3, wherein the bottom layer is securely attached to the top surface of the closure shell and the upper layer is removably attached to the bottom layer.

5. A tamper evident closure as defined in claim 4, wherein removal or partial removal of the closure cap from the top surface peels the upper layer away from the bottom layer.

6. A tamper evident closure as defined in claim 3, wherein the upper and bottom layers are constructed of a polymer.

7. A tamper evident closure as defined in claim 1, wherein the closure shell is constructed of a metal or polymer.

8. A tamper evident closure as defined in claim 1, wherein the closure cap is constructed of a flexible polymer.

9. A tamper evident closure as defined in claim 1, wherein the closure cap is at least partially transparent or translucent.

10. A tamper evident closure as defined in claim 1, wherein the tearable member is adhesively attached to the top surface of the closure shell.

11. A tamper evident closure as defined claim 1, wherein the tearable member defines a surface area of equal or less area than a surface area of the top surface of the closure shell.

12. A tamper evident closure as defined in claim 1, wherein the second aperture in the tearable member is smaller than the frangible portion of the top surface.

13. A tamper evident closure as defined in claim 1, wherein the first aperture in the top surface of the closure shell is generally centrally disposed on the closure shell, and the second aperture in the tearable member is in registry with the first aperture.

* * * * *